US008142975B2

(12) United States Patent
Vanbesien et al.

(10) Patent No.: US 8,142,975 B2
(45) Date of Patent: Mar. 27, 2012

(54) METHOD FOR CONTROLLING A TONER PREPARATION PROCESS

(75) Inventors: Daryl W. Vanbesien, Burlington (CA); Paul Gerroir, Oakville (CA); Karen A. Moffat, Brantford (CA); Melanie L. Davis, Hamilton (CA); Abdisamed Sheik-Qasim, Etobicoke (CA); David Kurceba, Hamilton (CA); Faisal Shamshad, Mississauga (CA); Michael D'Amato, Thornhill (CA); Juan A. Morales-Tirado, West Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/825,723

(22) Filed: Jun. 29, 2010

(65) Prior Publication Data

US 2011/0318685 A1 Dec. 29, 2011

(51) Int. Cl.
*G03G 5/00* (2006.01)

(52) U.S. Cl. ..... 430/137.14; 430/137.1

(58) Field of Classification Search ..... 430/137.1, 430/137.14

See application file for complete search history.

(56) References Cited

U.S. PATENT DOCUMENTS

| | | | |
|---|---|---|---|
| 5,278,020 | A | 1/1994 | Grushkin |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,943 | A | 12/1998 | Cheng et al. |
| 5,853,944 | A | 12/1998 | Foucher et al. |
| 5,863,698 | A | 1/1999 | Patel et al. |
| 5,869,215 | A | 2/1999 | Ong et al. |
| 5,902,710 | A | 5/1999 | Ong et al. |
| 5,910,387 | A | 6/1999 | Mychajlowskij et al. |
| 5,916,725 | A | 6/1999 | Patel et al. |
| 5,919,595 | A | 7/1999 | Mychajlowskij et al. |
| 5,922,501 | A | 7/1999 | Cheng et al. |
| 5,925,488 | A | 7/1999 | Patel et al. |
| 5,928,829 | A | 7/1999 | Cheng et al. |
| 5,977,210 | A | 11/1999 | Patel et al. |
| 6,063,827 | A | 5/2000 | Sacripante et al. |
| 6,096,465 | A * | 8/2000 | Kadokura et al. ..... 430/137.14 |
| 6,576,389 | B2 | 6/2003 | Vanbesien et al. |
| 6,593,049 | B1 | 7/2003 | Veregin et al. |
| 6,617,092 | B1 | 9/2003 | Patel et al. |
| 6,627,373 | B1 | 9/2003 | Patel et al. |
| 6,638,677 | B2 | 10/2003 | Patel et al. |
| 6,656,657 | B2 | 12/2003 | Patel et al. |
| 6,656,658 | B2 | 12/2003 | Patel et al. |
| 6,664,017 | B1 | 12/2003 | Patel et al. |
| 6,673,505 | B2 | 1/2004 | Jiang et al. |
| 6,730,450 | B1 | 5/2004 | Moffat et al. |
| 6,743,559 | B2 | 6/2004 | Combes et al. |
| 6,756,176 | B2 | 6/2004 | Stegamat et al. |
| 6,780,500 | B2 | 8/2004 | Dumouchel |
| 6,830,860 | B2 | 12/2004 | Sacripante et al. |
| 7,029,817 | B2 | 4/2006 | Robinson et al. |
| 2006/0154162 | A1 * | 7/2006 | Zhou et al. ..... 430/108.1 |
| 2008/0044754 | A1 * | 2/2008 | Marcello et al. ..... 430/110.2 |
| 2008/0107989 | A1 | 5/2008 | Sacripante et al. |
| 2008/0199797 | A1 | 8/2008 | Sacripante et al. |
| 2008/0268368 | A1 * | 10/2008 | Yuasa et al. ..... 430/137.14 |

* cited by examiner

*Primary Examiner* — Mark F Huff
*Assistant Examiner* — Stewart Fraser
(74) *Attorney, Agent, or Firm* — Oliff & Berridge, PLC

(57) ABSTRACT

A method of making toner particles, including mixing at least one emulsion of at least one resin, a colorant, an optional wax, and optional additives to form a slurry; heating the slurry to form aggregated particles in the slurry; freezing aggregation of the particles by adjusting the pH; and heating the aggregated particles in the slurry to coalesce the particles into toner particles.

15 Claims, No Drawings

METHOD FOR CONTROLLING A TONER PREPARATION PROCESS

TECHNICAL FIELD

This disclosure is directed to methods for smoothing the surfaces of toner particles, such as an emulsion aggregation toner, by controlling the coalescence pH during toner synthesis.

BACKGROUND

Emulsion aggregation (EA) toners are used in forming print and/or xerographic images. Emulsion aggregation techniques typically involve the formation of an emulsion latex of resin particles that have a small size of from, for example, about 5 to about 500 nanometers in diameter, by heating the resin, optionally with solvent if needed, in water, or by making a latex in water using an emulsion polymerization. A colorant dispersion, for example of a pigment dispersed in water, optionally with additional resin, is separately formed. The colorant dispersion is added to the emulsion latex mixture, and an aggregating agent or complexing agent is then added and/or aggregation is otherwise initiated to form aggregated toner particles. The aggregated toner particles are heated to enable coalescence/fusing, thereby achieving aggregated, fused toner particles. United States patent documents describing emulsion aggregation toners include, for example, U.S. Pat. Nos. 5,278,020; 5,290,654; 5,308,734; 5,344,738; 5,346,797; 5,348,832; 5,364,729; 5,366,841; 5,370,963; 5,403,693; 5,405,728; 5,418,108; 5,496,676; 5,501,935; 5,527,658; 5,585,215; 5,650,255; 5,650,256; 5,723,253; 5,744,520; 5,747,215; 5,763,133; 5,766,818; 5,804,349; 5,827,633; 5,840,462; 5,853,944; 5,863,698; 5,869,215; 5,902,710; 5,910,387; 5,916,725; 5,919,595; 5,925,488; 5,977,210; 6,576,389; 6,617,092; 6,627,373; 6,638,677; 6,656,657; 6,656,658; 6,664,017; 6,673,505; 6,730,450; 6,743,559; 6,756,176; 6,780,500; 6,830,860; and 7,029,817; and U.S Patent Application Publication No. 2008/0107989.

The disclosures of each of the foregoing patents and publications are hereby incorporated by reference herein in their entireties. The appropriate components and process aspects of each of the foregoing patents and publications may also be selected for the present compositions and processes in embodiments thereof.

SUMMARY

Although various toner compositions and methods for making toner compositions are known, the problem remains of providing toners that are capable of producing robust images that are substantially free of print defects such as background, spots, and smudges. One factor that contributes to these print defects is the presence of colorant on the surface of EA toner particles. The presence of colorant on the surface of EA toner particles broadens the charge distribution and causes low charge or no charge toner. The presence of non-coalesced latex particles on the toner surfaces also contributes to these problems.

Disclosed herein are methods for minimizing the amount of colorant present on the surface of EA toner particles, and toner particles produced by these methods. The inventors discovered that lowering the coalescence pH during toner synthesis significantly reduces the amount of colorant present on the surface of EA toner particles and produces a much smoother toner surface. This, in turn, results in a much higher charging toner that is capable of producing robust images that are substantially free of print defects such as background, spots, and smudges.

EMBODIMENTS

Resins and Polymers

The processes disclosed herein may be used to make styrene acrylate toners. Styrene resins and polymers are known in the art. Styrene resins may be formed from, for example, styrene-based monomers, including styrene acrylate-based monomers. Illustrative examples of such resins may be found, for example, in U.S. Pat. Nos. 5,853,943, 5,922,501, and 5,928,829, the entire disclosures of each being incorporated herein by reference.

Suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Specific amorphous resins include poly(styrene-acrylate) resins, crosslinked, for example, from about 10 percent to about 70 percent, polystyrene-acrylate) resins, poly (styrene-methacrylate) resins, crosslinked poly(styrene-methacrylate) resins, poly(styrene-butadiene) resins, crosslinked polystyrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, and crosslinked alkali sulfonated poly(styrene-butadiene) resins. Alkali sulfonated polyester resins may be used, such as the metal or alkali salts of copoly(ethylene-terephthalate)-copoly (ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly (propylene-butylene-terephthalate)-copoly(propylene-butylene-5-sulfo-isophthalate), and copoly(propoxylated bisphenol-A-fumarate)-copoly(propoxylated bisphenol A-5-sulfo-isophthalate).

Examples of other suitable latex resins or polymers include poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), polystyrene-propyl acrylate), poly (styrene-butyl acrylate), polystyrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly (styrene-butyl acrylate-acrylonitrile-acrylic acid), and combinations thereof. The polymers may be block, random, or alternating copolymers.

One, two, or more toner resins/polymers may be used. In embodiments where two or more toner resins are used, the toner resins may be in any suitable ratio (e.g., weight ratio) such as, for instance, about 10% first resin:90% second resin to about 90% first resin:10% second resin. The amorphous resin used in the core may be linear.

The resin may be formed by emulsion polymerization methods, or may be a pre-made resin.

Surfactants

Colorants, waxes, and other additives used to form toner compositions may be in dispersions that include surfactants. Moreover, toner particles may be formed by emulsion aggregation methods where the resin and other components of the toner are placed in contact with one or more surfactants, an emulsion is formed, toner particles are aggregated, coalesced, optionally washed and dried, and recovered.

One, two, or more surfactants may be used. The surfactants may be selected from ionic surfactants and nonionic surfactants. Anionic surfactants and cationic surfactants are encompassed by the term "ionic surfactants." The surfactant may be present in an amount of from about 0.01 to about 5 wt % of the toner composition, such as from about 0.75 to about 4 wt % weight of the toner composition, or from about 1 to about 3 wt % of the toner composition.

Examples of suitable nonionic surfactants include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octyiphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA210™, IGEPAL CA520™, IGEPAL CA-720™, IGEPAL CO-890™, IGEPAL CO-720™, IGEPAL CO290™, IGEPAL CA-210™, ANTAROX 890™, and ANTAROX 897™. Other examples of suitable nonionic surfactants include a block copolymer of polyethylene oxide and polypropylene oxide, including those commercially available as SYNPERONIC PE/F, such as SYNPERONIC PE/F 108.

Suitable anionic surfactants include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, DOWFAX™2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be used.

Examples of cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, cetyl pyridinium bromide, benzalkonium chloride, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Waxes

The resin emulsion may be prepared to include a wax. In these embodiments, the emulsion will include resin and wax particles at the desired loading levels, which allows for a single resin and wax emulsion to be made rather than separate resin and wax emulsions. Further, the combined emulsion allows for reduction in the amount of surfactant needed to prepare separate emulsions for incorporation into toner compositions. This is particularly helpful in instances where it would otherwise be difficult to incorporate the wax into the emulsion. However, the wax can also be separately emulsified, such as with a resin, and separately incorporated into final products.

In addition to the polymer binder resin, the toners may also contain a wax, either a single type of wax or a mixture of two or more preferably different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes may be added to provide multiple properties to the toner composition.

Examples of suitable waxes include waxes selected from natural vegetable waxes, natural animal waxes, mineral waxes, synthetic waxes, and functionalized waxes. Natural vegetable waxes include, for example, carnauba wax, candelilla wax, rice wax, sumacs wax, jojoba oil, Japan wax, and bayberry wax. Examples of natural animal waxes include, for example, beeswax, panic wax, lanolin, lac wax, shellac wax, and spermaceti wax. Mineral-based waxes include, for example, paraffin wax, microcrystalline wax, montan wax, ozokerite wax, ceresin wax, petrolatum wax, and petroleum wax. Synthetic waxes include, for example, Fischer-Tropsch wax; acrylate wax; fatty acid amide wax; silicone wax; polytetrafluoroethylene wax; polyethylene wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, diglyceryl distearate, dipropyleneglycol distearate, and triglyceryl tetrastearate; sorbitan higher fatty acid ester waxes, such as sorbitan monostearate; and cholesterol higher fatty acid ester waxes, such as cholesteryl stearate; polypropylene wax; and mixtures thereof.

In some embodiments, the wax may be selected from polypropylenes and polyethylenes commercially available from Allied Chemical and Baker Petrolite (for example POLYWAX™ polyethylene waxes from Baker Petrolite), wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasei K. K., and similar materials. The commercially available polyethylenes usually possess a molecular weight (Mw) of from about 500 to about 2,000, such as from about 1,000 to about 1,500, while the commercially available polypropylenes used have a molecular weight of from about 1,000 to about 10,000. Examples of functionalized waxes include amines, amides, imides, esters, quaternary amines, carboxylic acids or acrylic polymer emulsion, for example, JONCRYL 74, 89, 130, 537, and 538, all available from Johnson Diversey, Inc., and chlorinated polyethylenes and polypropylenes commercially available from Allied Chemical and Petrolite Corporation and Johnson Diversey, Inc. The polyethylene and polypropylene compositions may be selected from those illustrated in British Pat. No. 1,442,835, the entire disclosure of which is incorporated herein by reference.

The toners may contain the wax in any amount of from, for example, about 1 to about 25 wt % of the toner, such as from about 3 to about 15 wt % of the toner, on a dry basis; or from about 5 to about 20 wt % of the toner, or from about 5 to about 11 wt % of the toner.

Colorants

The toners may also contain at least one colorant. For example, colorants or pigments as used herein include pigment, dye, mixtures of pigment and dye, mixtures of pigments, mixtures of dyes, and the like. For simplicity, the term "colorant" as used herein is meant to encompass such colorants, dyes, pigments, and mixtures, unless specified as a particular pigment or other colorant component. The colorant may comprise a pigment, a dye, mixtures thereof, carbon black, magnetite, black, cyan, magenta, yellow, red, green, blue, brown, and mixtures thereof, in an amount of about 0.1 to about 35 wt % based upon the total weight of the composition, such as from about 1 to about 25 wt %.

In general, suitable colorants include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanent Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF), and carbon blacks such as REGAL 330 (Cabot), Carbon Black 5250 and 5750 (Columbian Chemicals), and the like, and mixtures thereof Additional colorants include pigments in water-based dispersions such as those commercially available from Sun Chemical, for example SUNSPERSE BHD 6011 X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 12273915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226), and the like, and mixtures thereof. Other water based colorant dispersions include those commercially available from Clariant, for example, HOSTAFINE Yellow GR, HOSTAFINE Black T and Black TS, HOSTAFINE Blue B2G, HOSTAFINE Rubine F6B, and magenta dry pigment such as Toner Magenta 6BVP2213 and Toner Magenta EO2 that may be dispersed in water and/or surfactant prior to use.

Other colorants include, for example, magnetites, such as Mobay magnetites MO8029, MO8960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like, and mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E. D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like, and mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like, and mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components, may also be selected as pigments.

The colorant, such as carbon black, cyan, magenta, and/or yellow colorant, is incorporated in an amount sufficient to impart the desired color to the toner. In general, pigment or dye is employed in an amount ranging from about 1 to about 35 wt % of the toner particles on a solids basis, such as from about 5 to about 25 wt %, or from about 5 to about 15 wt %. However, amounts outside these ranges can also be used.

Coagulants

Coagulants used in emulsion aggregation processes for making toners include monovalent metal coagulants, divalent metal coagulants, polyion coagulants, and the like. As used herein, "polyion coagulant" refers to a coagulant that is a salt or an oxide, such as a metal salt or a metal oxide, formed from a metal species having a valence of at least 3, at least 4, or at least 5. Suitable coagulants include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, aluminum sulfate, and the like. Other suitable coagulants include tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds may have from about 2 to about 13, such as from about 3 to about 8, aluminum ions present in the compound.

The coagulants may be incorporated into the toner particles during particle aggregation. As such, the coagulant may be present in the toner particles, exclusive of external additives and on a dry weight basis, in amounts of from 0 to about 5 wt % of the toner particles, such as from about greater than 0 to about 3 wt % of the toner particles.

Emulsion Aggregation Procedures

Any suitable emulsion aggregation procedure may be used and modified in forming the emulsion aggregation toner particles without restriction. These procedures typically include the basic process steps of at least aggregating an emulsion containing polymer binder, optionally one or more waxes, one or more colorants, one or more surfactants, an optional coagulant, and one or more additional optional additives to form aggregates; subsequently freezing particle aggregates, and coalescing or fusing the aggregates, and then recovering, optionally washing, and optionally drying the obtained emulsion aggregation toner particles.

In some embodiments, the emulsion aggregation processes comprise dispersing in water a latex of a first polymer or resin having a first glass transition temperature (Tg) and a colorant dispersion, and optionally adding to the emulsion a wax dispersion, and mixing the emulsion with high shear to homoginize the mixture.

To the homoginized mixture is added a coagulant solution comprising a coagulant and an aqueous acid solution to form a slurry. The coagulant may be present in an amount of about 0.01 wt % to about 10 wt % of the total weight of the coagulant solution, such as, for example, from about 0.05 wt % to about 1 wt %, or from about 0.1 wt % to about 0.5 wt %. The aqueous acid solution may be present in an amount of about 90 wt % to about 99.99 wt % of the total weight of the coagulant solution, such as, for example, from about 99 wt % to about 99.95 wt %, or from about 99.5 wt % to about 99.9 wt %. The pH of the slurry may be from about 1.5 to about 5.5, such as from about 1.5 to about 3,5, or from about 2.0 to 4.0, or from about 1.8 to about 2.4.

The slurry is then heated to a predetermined aggregation temperature of from about 30° C. to about 60° C., such as, for example, from about 30° C. to about 50° C., or from about 24° C. to about 60° C., or from about 49° C. to about 54° C. The heating may be conducted at a controlled rate of about 0.1° C./minute to about 2° C./minute, such as from about 0.3° C./minute to about 0.8° C./minute.

When the temperature of the slurry reaches the predetermined aggregation temperature, the slurry is maintained at the aggregation temperature within about 0.5° C., or within 0.4° C., or within 0.3° C., or within 0.2° C., or within 0.1° C. of the aggregation temperature while the aggregate grows to a predetermined first average particle size of from about 3 μm to about 20 μm, such as from 3 μm to about 10 μm, or from about 10 μm to about 20 μm, or from about 4 μm to about 7 μm.

Once the predetermined average particle size is achieved, a latex of a second polymer or resin having a second glass transition temperature (Tg) is introduced to the slurry while mixing. The resulting mixture is allowed to aggregate to reach a predetermined second average particle size. The second average particle size may be from about 0.1 μm to about 3.0 μm greater than the first average particle size, such as from about 0.2 μm to about 2.5 μm, or from about 0.3 μm to about 2.0 μm, or from about 0.5 μm to about 1.5 μm greater than the first average particle size.

Upon reaching the predetermined second average particle size, aggregation is frozen by adjusting the pH of the resulting mixture to a freezing aggregation pH of from about 5.0 to about 8.0, such as from about 5.1 to about 7.0, or from about 5.2 to about 6.0. This may be done by adding an aqueous base solution, such as, for example, NaOH. This mixture is then allowed to mix for an additional 0 to 30 minutes.

Subsequently, the resulting mixture is heated to a predetermined coalescence temperature of from about 85° C. to about 99° C., such as, for example, from about 85° C. to about 90° C., or from about 89° C. to about 99° C., or from about 88° C. to about 92° C. The heating may be conducted at a controlled rate of about 0.1° C./minute to about 1.5° C./minute, such as from about 0.3° C./minute to about 0.8° C./minute, or from about 0.5° C./minute to about 1.5° C./minute, or from about 0.9° C./minute to about 1.2° C./minute.

During the heating of the slurry to obtain the predetermined coalescence temperature, the pH is reduced to a predetermined coalescence pH when a predetermined coalescence pH adjustment temperature is reached by adding an aqueous acid solution, such as $HNO_3$. Lowering the pH allows the toner particle surface to flow and coalesces the toner to provide a smooth surface with low amounts of colorant on the surface of the toner particles. The predetermined coalescence pH adjustment temperature may be in a range of from about 0° C. to about 24° C. below the predetermined coalescence temperature, such as from about 5° C. to about 22° C., or from about 10° C. to about 20° C. below the predetermined coalescence temperature. The slurry is adjusted to a predetermined coalescence pH of from about 3.9 to about 5.0, such as from about 3.95 to about 4.8, or from about 4.0 to about 4.7.

When the slurry reaches the predetermined coalescence temperature, the temperature of the slurry is maintained at that temperature to allow the particles to coalesce. The coalesced particles may be measured periodically for circularity, such as with a Sysmex FPIA 2100 analyzer, until the desired circularity is achieved. A circularity of 1.000 indicates a completely circular sphere. The toner particles may have a circularity of about 0.920 to about 0.999, such as from about 0.940 to about 0.980, or from about 0.960 to about 0.980, or from about greater than or equal to 0.965 to about 0.990.

After coalescence, the mixture may be cooled to room temperature, such as from about 20° C. to about 25° C. The cooling may be rapid or slow, as desired. A suitable cooling method may include introducing cold water to a jacket around the reactor or a heat exchanger to quench. After cooling, the toner particles may be optionally washed with water, and then dried. Drying may be accomplished by any suitable method for drying including, for example, freeze-drying.

The cooling process may include an additional pH adjustment at a predetermined cooling pH adjustment temperature. The predetermined cooling pH adjustment temperature may be in a range of from about 40° C. to about 90° C. below the predetermined coalescence temperature, such as from about 45° C. to about 80° C., or from about 50° C. to about 70° C. below the predetermined coalescence temperature. The pH of the slurry is adjusted to a predetermined cooling pH of from about 7.0 to about 10, such as from about 7.5 to about 9.5, or from about 8 to about 9. The temperature of the slurry is maintained at the predetermined cooling pH adjustment temperature for a time period of from about 0 minutes to about 60 minutes, followed by cooling to room temperature.

Emulsion aggregation processes provide greater control over the distribution of toner particle sizes and by limiting the amount of both fine and coarse toner particles in the toner. In some embodiments, the toner particles have a relatively narrow particle size distribution with a lower number ratio geometric standard deviation (GSDn) of about 1.15 to about 130, such as from about 1.15 to about 1.25, or from about 1.20 to about 1.30. The toner particles may also exhibit an upper geometric standard deviation by volume (GSDv) in the range of from about 1.15 to about 1.30, such as from about 1.15 to about 1.21, or from about 1.18 to about 1.25.

Specifically, the disclosed emulsion aggregation processes may be used to produce toner particles that have an ultraviolet absorption of 0.025 or less at 600 nm, which reflects a low amount of free carbon black pigment on the toner surface. Surface free carbon black is determined by suspending dry toner in an aqueous surfactant solution, sonicating the solution for 90 minutes, centrifuging out the toner, and analyzing the supernatant by a spectrophotometer (of Hitachi, Limited) for its absorption of ultraviolet radiation having a wavelength of 600 nm. Carbon black has a very strong absorption at 600 nm. For example, the toner particles may have an ultraviolet absorption of 0.025 or less at 600 nm of from about 0 to about 0.020, or from about 0.005 to about 0.015, or from about 0.015 to 0.025.

The toner and developer compositions comprising the toner particles may exhibit triboelectric charging values in a range of from about 32 to 48 μC/g, as measured by the standard Faraday Cage technique.

EXAMPLES

Comparative Example

Into a 20 gallon reactor equipped with a two P-4 impeller system and a heat-transfer jacket was dispersed into 38 kg of water:

15 kg of a styrene acrylate latex (Tg=51, solids content=41.57%), 4 kg of polyethylene wax dispersion (Tm=90° C., solids content=31%), 4.16 kg of a Regal 330 carbon black dispersion (solids content=17%), with high shear stirring by means of an inline homogenizer. To this mixture was added 1.98 kg of a coagulant solution consisting of 10 wt % polyaluminium chloride (PAC) and 90 wt % 0.02M $HNO_3$ solution.

The slurry was heated at a controlled rate of 0.5° C./minute up to approximately 52° C. and held at this temperature to grow the particles to approximately 5.8 μm. Once the average particle size of 5.9 μm was achieved, 7.6 kg of a different styrene acrylate latex (Tg=55° C., solids content=41.57%) was then introduced into the reactor while mixing. After an additional 30 minutes to 1 hour, the particle size measured was 6.7 μm with a GSDv of 1.18 and GSDn of 1.21.

The pH of the resulting mixture was then adjusted from 2.0 to 5.4 with aqueous base solution of 4% NaOH and allowed to mix for an additional 15 minutes. This pH adjustment may be referred to herein as the freezing step.

Subsequently, the resulting mixture was heated to a coalescence temperature of 96° C. at 1.0° C. per minute while maintaining a pH of 5.4 and the particle size measured was 6.8 μm with a GSDv of 1.18 and GSDn of 1.21. At 80° C., as the slurry was heating to the coalescence temperature, the pH of the slurry was maintained at pH 5.4. The resultant mixture was then allowed to coalesce for 3 hours at a temperature of 96° C., while the circularity was monitored every 30 minutes. When the circularity reached 0.963, the pH was adjusted to 6.8 and the toner slurry was coalesced for a total coalescence time of 3 hours.

Upon cool-down, when the temperature reached 63° C., the slurry was pH adjusted to 8.8 and held for 20 minutes followed by cooling down to room temperature. This may be referred to herein as the cooling pH adjustment. The particles were then washed at room temperature using deionized water 3 times, wherein the second wash was at pH 4.0, followed by drying.

The disclosed emulsion aggregation processes may be used to produce toner particles that have an ultraviolet absorption of 0.025 or less at 600 nm, which reflects a low amount of free carbon black pigment on the toner surface. The following procedure may be used to measure ultraviolet absorption at 600 nm:

(1) One part by weight of a toner is placed in a sample bottle with 90 parts by weight of ion-exchange water and 0.5 part by weight of a surface active agent (Triton X100);

(2) The toner is stirred on a vortex mixer for ten seconds and then ultrasonically cleaned for ninety minutes;

(3) The toner is separated by a centrifugal separator operating at 4600 rpm for ten minutes;

(4) The supernatant in the bottle is collected by a pipette; and (5) The supernatant is analyzed by a spectrophotometer (of Hitachi, Limited) for its absorption of ultraviolet radiation having a wavelength of 600 nm.

Examples 1-5

The process outlined in the Comparative Example was repeated, with the coalescence step in each example being modified to adjust the coalescence pH at 80° C. to a different pH using a 0.3 M $HNO_3$ acid solution, as shown in Table 1. Additionally, in Example 5, the coalescence temperature was 90° C. instead of 96° C.

TABLE 1

| Example | Coalescence pH | Coalescence Temperature | $D_{50}$ (μm) | GSDv | GSDn | Circularity | UV ABS at 600 nm |
|---|---|---|---|---|---|---|---|
| Comp. | 5.4 | 96° C. | 6.78 | 1.220 | 1.258 | 0.973 | 0.068 |
| 1 | 5.0 | 96° C. | 6.83 | 1.182 | 1.272 | 0.980 | 0.014 |
| 2 | 4.7 | 96° C. | 6.75 | 1.182 | 1.220 | 0.979 | 0.005 |
| 3 | 4.4 | 96° C. | 6.76 | 1.195 | 1.272 | 0.978 | 0.006 |
| 4 | 4.2 | 96° C. | 6.75 | 1.182 | 1.272 | 0.980 | 0.001 |
| 5 | 4.2 | 90° C. | 6.81 | 1.182 | 1.220 | 0.970 | 0.002 |

The Comparative Example illustrates that at pH 5.4 at 80° C. there is significant surface carbon black. Examples 1-5 illustrate that as the pH of coalescence was decreased, the surface carbon black improves significantly and finally when coalesced at pH of 4.2, the surface carbon black is substantially non-existent. It was also found that a coalescence pH of 4.2 enabled a lower coalescence temperature, which provides a significant energy and time savings for the production of the toner particles.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method of making toner particles, comprising:

forming a slurry by mixing together an emulsion comprising:

a latex of a first polymer or resin, a colorant, an optional wax, and optional additives;

heating the slurry to a predetermined aggregation temperature and maintaining the slurry within 0.5° C. of the aggregation temperature to form aggregated particles in the slurry;

forming a shell on the aggregates by adding a latex of a second polymer or resin to the slurry while mixing;

freezing aggregation of particles by raising a pH of the aggregated particles and slurry mixture to a freezing aggregation pH;

heating the mixture to a predetermined coalescence pH adjustment temperature, and then lowering the pH of the mixture to a predetermined coalescence pH;

heating the mixture to a predetermined coalescence temperature at a controlled rate of about 0.1° C./min to about 1.5° C./min; and maintaining the temperature of the mixture at the coalescence temperature to coalesce the aggregates into toner particles.

2. The method of claim 1, wherein the first polymer or resin is selected from the group consisting of styrene acrylate resins, UV curable resins, and polyester resins.

3. The method of claim 1, wherein the second polymer resin is selected from the group consisting of styrene acrylate resins, UV curable resins, and polyester resins.

4. The method of claim 1, wherein the coalescence pH is from about 3.9 to about 5.0.

5. The method of claim 1, wherein the coalescence pH adjustment temperature is from about 75° C. to about 85° C.

6. The method of claim 1, wherein the coalescence temperature is from about 85° C. to about 99° C.

7. The method of claim 1, wherein the aggregation temperature is from about 45° C. to about 54° C.

8. The method of claim 1, further comprising, after coalescence of the aggregates into toner particles, cooling the particle to a cooling pH adjustment temperature, and adjusting a pH of the particles to a cooling pH of from about 7.5 to about 10.

9. The method of claim 8, wherein the cooling pH adjustment temperature is from about 50° C. to about 70° C.

10. The method of claim 1, wherein the toner particles have an ultraviolet absorption of 0.025 or less at 600 nm.

11. The method of claim 4, wherein the toner particles have an ultraviolet absorption of 0.025 or less at 600 nm.

12. The method of claim 1, wherein the toner particles have a circularity of from about 0.970 to about 0.980.

13. The method of claim 1, wherein the toner particles have triboelectric charging values in a range of from about 32 to 48 μC/g.

14. A method of making toner particles, comprising:

forming a slurry by mixing together an emulsion comprising:

a styrene acrylate latex, the styrene acrylate having a glass transition temperature of 51° C., a polyethylene wax dispersion, a carbon black dispersion, and a coagulant solution comprising polyaluminium chloride (PAC) and an aqueous acid solution;

heating the slurry to a predetermined aggregation temperature of 52° C. and maintaining the slurry within 0.5° C. of the aggregation temperature to form aggregated particles in the slurry;

forming a shell on the aggregates by adding a latex of a styrene acrylate having a glass transition temperature of 55° C. to the slurry while mixing;

freezing aggregation of the particles by raising a pH of the aggregated particles and slurry mixture to a freezing aggregation pH of 5.2;

heating the mixture to a predetermined coalescence pH adjustment temperature of 80° C., and then lowering the pH of the mixture to a predetermined coalescence pH of from about 3.9 to about 5.0;

heating the mixture to a predetermined coalescence temperature from about 85° C. to about 99° C.; and maintaining the temperature of the mixture at the coalescence temperature to coalesce the aggregates into toner particles.

15. The method of claim 14, wherein the toner particles have an ultraviolet absorption of 0.025 or less at 600 nm.

* * * * *